US005666979A

United States Patent [19]

Chase

[11] Patent Number: 5,666,979

[45] Date of Patent: Sep. 16, 1997

[54] CIGAR SUBSTITUTE

[76] Inventor: Gene Chase, 2006 Delaware Ave., #2, Buffalo, N.Y. 14216-3528

[21] Appl. No.: 314,849

[22] Filed: Sep. 29, 1994

[51] Int. Cl.[6] ..... A24F 47/00

[52] U.S. Cl. ..... 131/270

[58] Field of Search ..... 131/270–273; 604/77

[56] References Cited

U.S. PATENT DOCUMENTS

| | | | |
|---|---|---|---|
| 1,678,562 | 7/1928 | Edens | 604/77 X |
| 3,071,476 | 1/1963 | Werft et al. . | |
| 3,789,840 | 2/1974 | Rosenblatt . | |
| 3,877,468 | 4/1975 | Lichtneckert et al. . | |
| 4,237,884 | 12/1980 | Erickson et al. | 604/77 X |
| 4,774,971 | 10/1988 | Vieten . | |
| 4,778,677 | 10/1988 | Ebbesen . | |
| 4,784,641 | 11/1988 | White | 604/77 |
| 4,907,605 | 3/1990 | Ray et al. . | |
| 4,971,079 | 11/1990 | Talapin et al. . | |
| 5,016,652 | 5/1991 | Rose et al. . | |
| 5,048,544 | 9/1991 | Mascarelli et al. . | |
| 5,181,505 | 1/1993 | Lew et al. | 604/77 X |
| 5,377,879 | 1/1995 | Isaacs | 604/77 X |
| 5,500,433 | 3/1996 | Carr et al. . | |

FOREIGN PATENT DOCUMENTS

| | | |
|---|---|---|
| 9106288 | 5/1991 | Denmark . |
| 9623 | of 1905 | United Kingdom . |

*Primary Examiner*—Jennifer Bahr

[57] ABSTRACT

A device to aid in the cessation of tobacco use having an inedibe, elongate flexible tube with one or more lumens. At least one lumen contains a mixture to reduce the desire for tobacco, comprised of nicotine, or a nicotine derivative, or a nicotine substitute, or a nicotine substitute derivative, or a mixture thereof, and an edible carrier substance, and a flavoring substance.

2 Claims, 1 Drawing Sheet

FIG. 1

CIGAR SUBSTITUTE

FIELD OF INVENTION

This invention is directed to an anti-smoking device. More specifically, this invention relates to a cigar substitute. The cigar substitute is intended to assist smokers who wish to end their smoking habit permanently. By the term "smoking" as used herein is meant the combustion of cigars, cigarettes, pipes, use of oral tobacco and the like where oral fixation and nicotine dependency are side effects.

BACKGROUND—DESCRIPTION OF PRIOR ART

The potential hazardous effects of tobacco use, and environmental smoke are well documented and need not be repeated here. As a result, a clear need has developed for a product to suppress the desire for tobacco, while providing oral and manual stimulation to replace the rituals of tobacco use.

Heretofore, products available to assist smokers who wish to end their smoking habit include;

(a) Gum containing nicotine or nicotine substitutes, which release substances by chewing that are absorbed through the buccal mucosa;

(b) Transdernmal patch, which releases a substance into the bloodstream through the skin;

(c) Various lozenges and tablets containing either nicotine, or a nicotine substitute such as lobeline sulfate;

(d) Cigarette facsimiles which may or may not contain chemical substances;

(e) Nasal Spray containing nicotine.

All of the aforementioned devices have one or more of the following disadvantages:

(a) Expensive to manufacture;

(b) Do not provide manual stimulation to the user;

(c) Do not provide oral stimulation to the user;

(d) Do not contain substances that reduce the desire to smoke;

(e) Do not address the cigar smoker's habit of chewing the end of the cigar.

(f) Are capable of being swallowed, resulting in a possible overdose, or voiding of effects to the user.

(g) Cause irritation to the user's skin or mucosa.

(h) Can not be used with, or may cause damage to dental work

"Chewable Tobacco Substitute Composition" or gum, as disclosed in U.S. Pat. No. 3,877,468, issued on Apr. 15, 1975 to Lichtneckert, et al., and U.S. Pat. No. 4.971,079, issued on Nov. 20, 1990 to Talpin, et al., and other similar preparation tend to be costly to manufacture, and do not provide manual stimulation to the user, as these products are not easily removed from the mouth or played with in the hands. Furthermore, these devices may be swallowed whole, voiding any possible benefit to the user.

Oral Tobacco Substitutes, as disclosed in U.S. Pat. No. 4,907,605, issued on Mar. 13, 1990 to Ray, et al., also do not provide manual stimulation to the user, and may be swallowed whole, voiding any benefit to the user.

Transdernmal Patches, as disclosed in U.S. Pat. No. 5,016,652, issued on May 21, 1991, to Rose et al., do not provide for oral or manual stimulation to the user, and may cause skin irritation to the user.

Lozenges and tablets, as disclosed in Danish Patent No. WO91/06288, issued on May 16, 1991, to Anders do not provide manual stimulation to the user, and may be swallowed whole, resulting in a possible overdose to the user.

Facsimile Cigarettes, as disclosed in U.S. Pat. No. 4,774,971, issued on Oct. 4, 1988, to Vieten, and other similar devices require complex manufacturing processes, and either do not provide substances to reduce the desire to smoke, or use a nicotine confection that may be swallowed whole. These devices can not be chewed, and therefore do not address the needs of the cigar smoker.

"Nicotine Lolipop" as disclosed in U.S. Pat. No. 5,048,544, issued on Sep. 17, 1991 to Mascarelli, may be swallowed whole, resulting in an overdose of nicotine to the user.

"Nicotine Nasal Spray" as manufactured by Kabi Pharmacia, does not provide oral stimulation, and may cause nasal irritation to the user.

Furthermore, none of the above mentioned devices address the cigar smoker's habit of chewing on the end of the cigar as it is smoked, while allowing the user to remove the cigar from the mouth and manipulate it in the hands.

OBJECT AND ADVANTAGES

Accordingly, several objects and advantages of the present invention are to provide a substitute for tobacco use with the following characteristics:

(a) Inexpensive to manufacture;

(b) Provides manual stimulation to the user;

(c) Provides oral stimulation to the user;

(d) Contains a substance that reduces the desire to smoke;

(e) Simulates chewing the end of a cigar;

(f) Is not easily swallowed;

(g) Will not cause irritation to the user;

(h) Will not damage or stick to dental work.

DESCRIPTION OF INVENTION

Accordingly, the present invention is comprised of an inedible, flexible, elongated tube with one or more lumens. At least one lumen will contain an edible mixture comprised of either nicotine, nicotine derivatives or a nicotine substitute or a nicotine substitute derivative or a mixture thereof in an edible carrier such as gelatin, and a flavoring substance. The term "nicotine substitute" as used herein means any substance known to reduce the desire to smoke or use tobacco, such as lobeline sulfate and the like.

When the urge for tobacco is felt, the user will place one end of the tube in the mouth, the other end of the tube protruding out of the mouth. The end of the tube held in the mouth is gently chewed, simulating chewing the end of a cigar, and breaking the seal if the tube is sealed. In chewing, the mixture contained in the lumen(s) is slowly released into the mouth, and absorbed through the buccal mucosa, reducing the (pharnmacologic) desire to smoke. The tube may be removed from the mouth at any time and played with, simulating the holding and ashing rituals of smoking.

The present invention is easily and inexpensively manufactured by extrusion, provides oral and manual stimulation to the user, provides a substance to supress the (pharmacological) desire to smoke, will not stick to or damage dental work, will not cause skin or nasal irritation to the user, is difficult to swallow whole, and simulates chewing the end of a cigar when in use. The unique design also eliminates the need for elaborate packaging to contain the substances inside the tube lumen(s).

RAMIFICATIONS AND SCOPE

One of the preferred embodiments of this invention is a single tube comprised of polyethylene or polypropylene plastic, or other similar flexible, inedible material that can be chewed. The tube will be approximately 15.24 centimeters (approximately 6 inches) in length, and approximately (0.3175 centimeters (approximately 0.125 inches) in diameter, with an interior volume of approximately 1 cubic centimeter. These tubes are commonly known as "cocktail straws" or hollow "swizzle sticks" and are commonly used to stir mixed drinks or coffee. These tubes may have more than one lumen and be held together lengthwise by various means and in various configurations without departing from the spirit and scope of this invention. The lumens in a multi-lumen configuration may contain various substances, or may be left empty, as long as at least one lumen contains a substance known to reduce the desire to smoke. The lumen(s) may be sealed at one or both ends by heat, pinching, plugging, ultrasound, or a combination of methods, without departing from the spirit and scope of this invention.

In one of the preferred embodiments of this invention, at least one lumen will contain a quantity of nicotine, nicotine derivative, or nicotine substitute, or nicotine substitute derivative, or a mixture thereof, in a quantity sufficient to reduce the desire to smoke. In one of the preferred embodiments of this invention approximately 4 milligrams of nicotine per unit have been known to be sufficient to suppress the desire for tobacco. However, other concentrations of nicotine may be used, and other substances known to supress the desire for tobacco in various concentrations may be used without departing from the spirit and scope of this invention.

In one of the preferred embodiments of this invention, the nicotine will be carried in an edible mixture contained inside at least one tube lumen. In one of the preferred embodiments of this invention, the edible carrier substance is gelatin. Other such edible carrier substances or confections may be used without departing from the spirit and scope of this invention.

In one of the preferred embodiments of this invention, the edible carrier substance mixture contained inside at least one tube lumen will also contain a flavoring substance. In one of the preferred embodiments of this invention, the flavoring substance is mint extract.

In one of the preferred embodiments of this invention, one or both ends of the tube lumen(s) will be sealed by pinching, plugging, folding, thermosealing, ultrasound, or a combination of methods. In one of the preferred embodiments of this invention, both ends of the tube lumen are thermosealed. Any sealing method may be used to one or both ends of the tube without departing from the spirit and scope of this invention.

The preferred embodiments as described above, are not intended to define the limits and scope of the present invention, and it is to be understood that the invention is not limited to those precise embodiments, and that various changes and modifications may be effected therein by one skilled in the art without departing from the spirit and scope of the present invention.

BRIEF DESCRIPTION OF THE DRAWING FIGURES

In the drawings, wherein similar reference numerals denote similar features throughout the several views:

FIGS. 1–4 illustrate various preferred configurations of tube lumen(s) of the cigar substitute of the present invention. The inedible, elongate tube is shown as 10, and the lumen(s) shown as 11 throughout the figures. The mixture contained inside the lumen(s) has not been illustrated to preserve the clarity of the drawings.

DETAILED DESCRIPTION OF DRAWINGS

Figure 1:
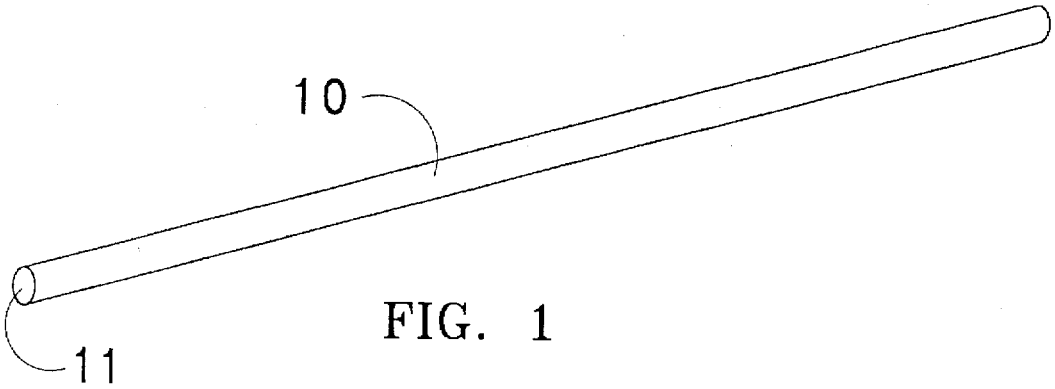
FIG. 1 is a perspective view of a cigar substitute of the present invention, showing the inedible, elongate tube 10 with one lumen 11 containing the mixture as described above.
Figure 2:
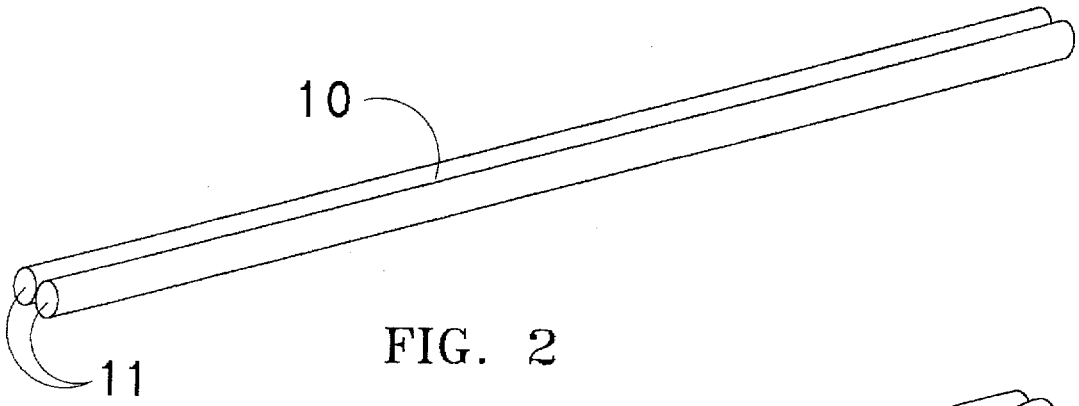
FIG. 2 is a perspective view of a cigar substitute of the present invention showing the inedible elongate tube 10 with two lumens 11, one or both of which may contain the mixture as described above.
Figure 3:
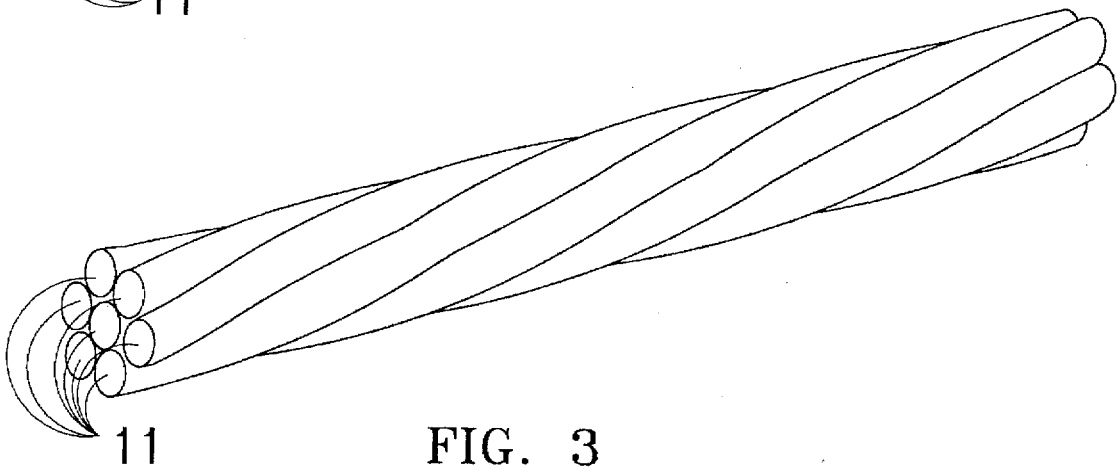

FIG. 3 is a perspective view of a cigar substitute of the present invention showing the inedible, elongate tube 10 with multiple lumens 11. In this particular configuration, the lumens 11, at least one of which contains the mixture as described above, are shown in a twisted configuration, however, the lumens 11 may be arranged in various configurations, and held together by various means without departing from the spirit and scope of the present invention.

Figure 4:
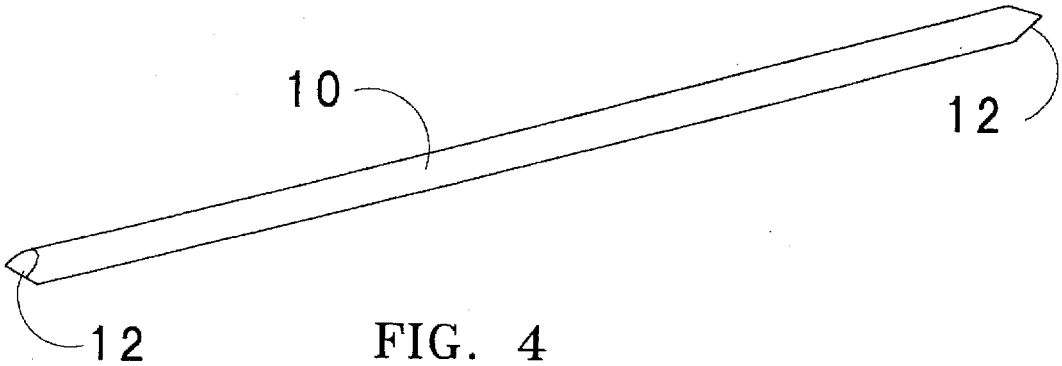

FIG. 4 is a perspective view of a cigar substitute of the present invention showing the inedible, elongate tube 10 with one lumen (not illustrated). In this figure, the ends of the inedible, elongate tube 10 and the lumen (not illustrated) have been sealed 12.

While only several embodiments of the present invention have been shown and described, it will be obvious to those of ordinary skill in the art that many modifications may be made to the present invention without departing from the spirit and scope thereof.

I claim:

1. A cigar substitute, comprised of an elongate, inedible, flexible tube with one or more lumens, said tube having a length on the order of approximately 15.24 centimeters, so as to protrude from the mouth of the user, at least one said lumen containing a mixture known to reduce the desire for tobacco, said mixture being comprised of nicotine, or nicotine derivative, or nicotine substitute, or nicotine substitute derivative, or a mixture thereof, and an edible carrier substance, and a flavoring substance.

2. A clear substitute according to claim 1 wherein one or both ends of said tube and said tube lumen are sealed.

* * * * *